United States Patent [19]

Sage et al.

[11] Patent Number: 4,630,323

[45] Date of Patent: Dec. 23, 1986

[54] BATHTUB LINER

[76] Inventors: Dennis R. Sage; Monica M. Sage, both of 1204 E. Bethany Home, Phoenix, Ariz. 85014

[21] Appl. No.: 761,689

[22] Filed: Aug. 2, 1985

[51] Int. Cl.[4] ..... A47K 3/02

[52] U.S. Cl. ..... 4/580; 4/581; 4/583

[58] Field of Search ..... 4/580, 581, 582, 583, 4/661

[56] References Cited

U.S. PATENT DOCUMENTS

| | | | |
|---|---|---|---|
| 2,264,672 | 12/1941 | Levine | 4/580 |
| 2,495,602 | 1/1950 | Rinaldi | 4/583 |
| 3,045,254 | 7/1962 | Cook et al. | 4/580 |
| 3,133,292 | 5/1964 | Spier | 4/580 |
| 3,892,000 | 7/1975 | Morse | 4/580 |
| 3,931,652 | 1/1976 | Navarra | 4/580 X |

*Primary Examiner*—Henry K. Artis

*Attorney, Agent, or Firm*—Drummond & Nissle

[57] ABSTRACT

An improved bathtub liner. The bathtub liner includes resilient pads encapsulated by a covering having a smooth continuous surface which detachably adheres to the inner surfaces of a bathtub and resists shear forces which tend to cause the continuous surface to slide over the inner surfaces of the bathtub. The bathtub liner includes a bottom pad shaped to cause water to flow under the force of gravity down the pad toward the bathtub drain when the tub is being emptied of water.

3 Claims, 10 Drawing Figures

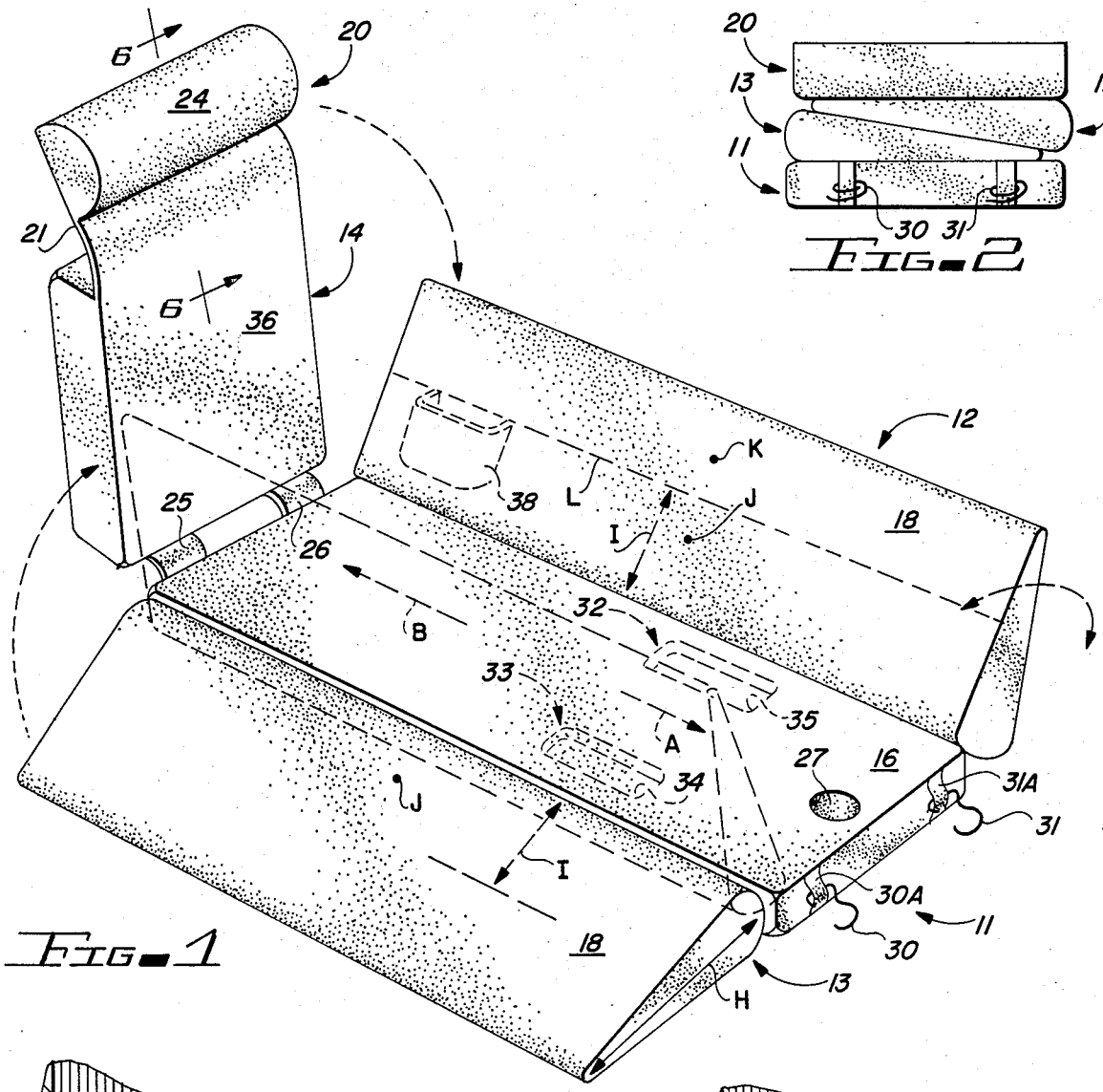
FIG. 1
FIG. 2
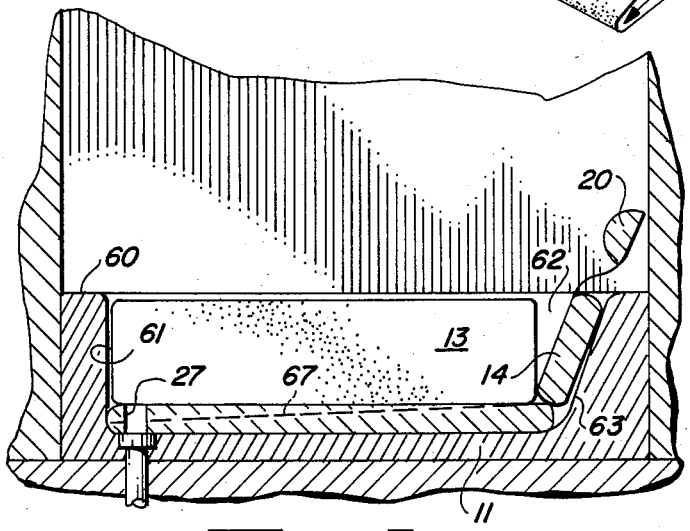
FIG. 3
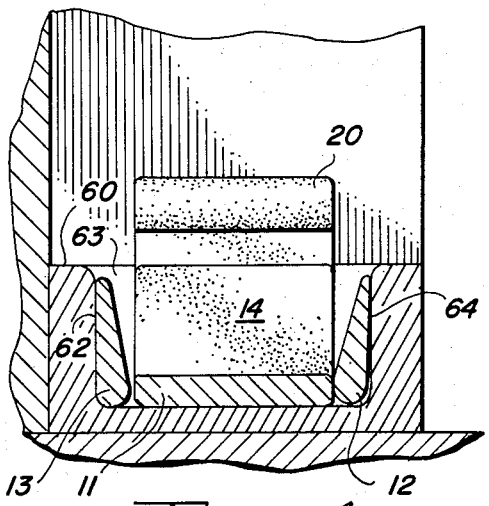
FIG. 4

BATHTUB LINER

This invention pertains to apparatus for covering the inner surfaces of a bathtub.

More particularly, the invention pertains to apparatus for providing a bathtub having soft pliable inner surfaces which contour to and support the body of a person bathing in the tub.

In a further respect, the invention pertains to a bathtub liner having a bottom pad shaped to cause water to flow under the force of gravity down the pad toward the bathtub drain when the tub is being emptied of water.

In another respect, the invention pertains to a bathtub liner including resilient pads encapsulated by a covering having a smooth continuous surface which detachably adheres to the surface of a bathtub and resists shear forces which tend to cause the continuous surface to slide over the surface of the bathtub.

In still a further respect, the invention pertains to a bathtub liner having a base pad which fits over the bottom of a bathtub and having a side pad which covers a side surface of a bathtub, the side pad being secured to the base pad by means which tend to force the side pad against the side surface of the bathtub when the liner is installed therein.

Bath mats and bathtub liners are well-known in the art. See, for example, U.S. Pat. Nos. 3,091,779 to Lucas, 4,512,044 to Clark, 3,408,663 to Bunting, 861,916 to Stein, 2,495,602 to Rinaldi, 1,510,647 to Boumar, and 85,859 to Capouch. Such prior art bathtub mats and liners have several disadvantages. Each liner only fits one size of bathtub and does not evenly support and cushion the portions of an individual's body contacting the liner, making it uncomfortable for the individual to occupy the tub for an extended length of time. Such liners also usually have smooth slipery surfaces and do not prevent a person attempting to sit upright on the liner in a tub from sliding over the liner toward the bathtub drain; do not support the head and neck of the person when he is sitting and leaning against one end of the tub; and, do not facilitate drainage of water from the tub after bathing is completed. Finally, some existing bathtub liners, such as the liner system disclosed in U.S. Pat. No. 2,495,602 to Rinaldi, are impractical to install in a bathtub because they require utilization of an auxiliary bracing system to position resilient pads in a bathtub.

Accordingly, it would be highly desirable to provide an improved bathtub liner which could be readily installed in and removed from a bathtub, would evenly support portions of an individual's body contacting the liner, and would provide support for the individual's head and neck when he was seated in the tub.

Therefore, it is a principal object of the invention to provide an improved bathtub liner.

A further object of the invention is to provide an improved bathtub liner which generally covers all interior surfaces of a bathtub with a pliable material and can be readily installed in and removed from the tub.

Another object of the invention is to provide an improved bathtub liner which facilitates drainage of water from a bathtub and can, after being removed from the tub, be folded for ready transport.

Still a further object of the invention is to provide an improved bathtub liner in which resilient panels covering the inner surfaces of a tub maintained in position against the surfaces without requiring the use of braces or other auxiliary support systems.

These and other, further and more specific objects and advantages of the invention will be apparent to those skilled in the art from the following detailed description thereof, taken in conjunction with the drawings, in which:

FIG. 1 is a perspective view of a bathtub liner constructed in accordance with the principles of the invention;

FIG. 2 is a right-hand end view of the portable bathtub liner of FIG. 1 illustrating the mode of operation thereof;

FIG. 3 is a side section view illustrating the portable bathtub liner of FIG. 1 installed in a bathtub;

FIG. 4 is an end section view illustrating the portable liner of FIG. 1 installed in a bathtub;

Figure 5:
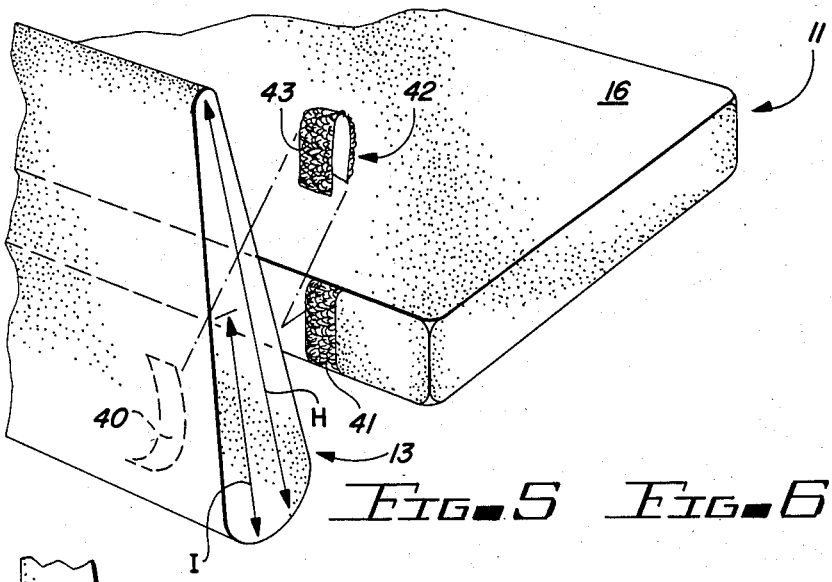
FIG. 5 is a partial perspective view of the bathtub liner of FIG. 1 illustrating the assembly thereof.
Figure 6:
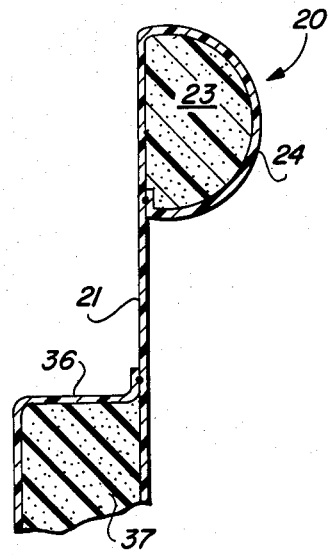
FIG. 6 is a side section view of a portion of the portable bathtub liner of FIG. 1 taken along section line 6—6 thereof.

Briefly, in accordance with our invention, we provide an improved liner for a bathtub. The bathtub includes an upper peripheral edge, a bottom surface and side surfaces. The bathtub liner includes a first resilient pad shaped, contoured and dimensioned to fit over the bottom surface of a bathtub, the pad having a pair of ends and including an inner core of resilient material enclosed by a layer of water resistent material, the water resistent material being adapted to detachably adhere to the bottom surface of a bathtub, the pad tapering from one of the ends to the other of the ends such that water in the bathtub flows under the force of gravity from one of the ends down the pad toward the bathtub drain when water is being emptied from the bathtub through the drain; and, a second pad attached to the first pad and shaped and dimensioned to fit over one of the side surfaces of the bathtub, the second pad including an inner core of resilient material enclosed by a layer of water resistent material, the water resistent material being adapted to detachably adhere to the side surface. The second pad is secured to the first pad such that the second pad can be folded over the first pad.

Turning now to the drawings, which depict the presently preferred embodiments of the invention for the purpose of illustrating the practice thereof and not by way of limitation of the scope of the invention, and in which like reference characters represent corresponding elements throughout the several views, FIGS. 1 to 10 illustrate the presently preferred embodiments of the invention including panel-shaped bottom pad 11 and side pads 12, 13 and 14. Bottom pad 11 includes a core of foam or other resilient material 15 enclosed by a layer 16 of plastic or other waterproof or water-resistent material. Side panels 12–14 similarly include a core of foam or other resilient material 17 sealed by a layer 18 of plastic or other water-resistent material. Resilient material 37 in pad 14 is encapsulated by waterproof sheet 36. Headrest 20 is attached to pad 14 by flexible strip 21 and includes inner core 23 of resilient material encased by water-resistent layer 24. Strip 21 can be rigid. Flexible straps 25, 26 interconnect side pad 14 and bottom pad 11. Straps 25, 26 are long enough to permit side pad 14 and headrest 24 to be folded over pads 11–13 in the manner illustrated in FIG. 2. Aperture 27 formed through pad 11 permits water to flow from above pad 11 into the drain of a bathtub. Hooks 30, 31 attached to pad 11 permit the bathtub liner of the invention to be suspended from a shower curtain bar, preferably after the liner is folded in the manner shown in FIG. 2. Footrest indents 32, 33 can be formed in pad 11 to receive an individual's feet when he is sitting on pad 11 with his back against upright pad 14. When an individual is sitting on pad 11 with his feet in indents 32, 33 he can press his feet in the direction of arrow A against walls 34, 35 to force his back and buttocks in the direction of arrow B against pad 14. Accordingly, footrest indents 32, 33 can be particularly useful if water resistent sheet material 16 is slipery when wet. Sheet material 16 preferably comprises a substance which frictionally adheres to the skin of an individual when pad 11 is wet. Further, sheets 16, 18, 24, 36 preferably comprise a material which detachably adheres to the porcelain or plastic walls of a bathtub in a manner similar to that in which Saran wrap detachably sticks to a porcelain bowl or in which the adhesive on the back of a piece of paper in a Scotch® 3M Post-It® note pad detachably adheres to paper and other objects. Sheets 16, 18, 24, 36 can include an outer layer of a substance (such as the adhesive on a piece of paper in a Scotch 3M Post-It pad) that detachably adheres to the side of a bathtub or can include an outer layer of a substance which inherently (like Saran wrap) detachably adheres to the inner surface of a bathtub. When pads 11–14 detachably adhere to the inner surfaces of a bathtub, the liner tends to maintain its position in a bathtub (shown in FIG. 3) without requiring the use of an auxiliary bracing system similar to that described in U.S. Pat. No. 2,495,602 to Rinaldi. Elastic pouch 38 is attached to pad 12 and can be folded or compressed into a generally flat storage position against the face of pad 12 or can be pulled away from pad 12 as shown in FIG. 1 to receive a container of shampoo or other material.

As depicted in FIG. 5, opposing strip pairs of negative hook and loop material or Velcro® 40, 41 are attached to side pads 12, 13 and bottom pad 11 and are interconnected by elastic bands 42 having positive hook and loop strips 43 thereon. Bands 42 can be attached to an opposing strip pair 40, 41 such that pads 12–14 can be folded over pad 11 in the manner shown in FIG. 2. Strips 40–42 are sized such that side pads 12–14 can be positioned on top of pad 11—as is pad 14 in FIG. 4—or be positioned to the side of pad 11—as are pads 12, 13 in FIG. 4.

Figure 7:
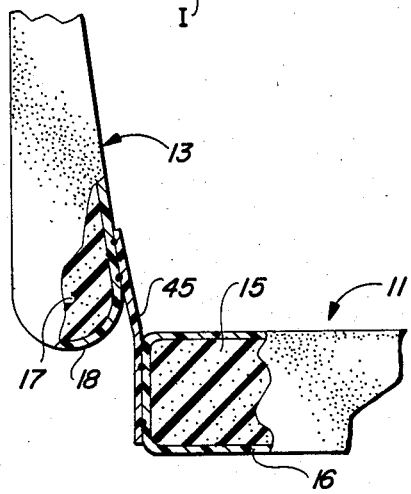
FIG. 7 is a side section view of the portable bathtub liner of FIG. 1 illustrating the inner connection of resilient pads thereof.
Figure 8:
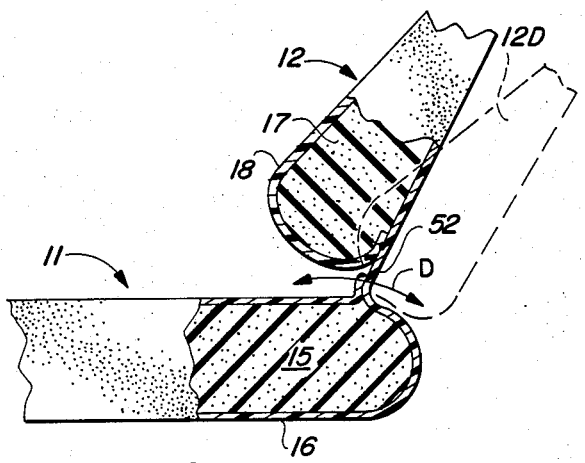
FIG. 8 is a side section view of the portable bathtub liner of FIG. 1 illustrating an alternate method of interconnecting the resilient pads thereof.
Figure 9:
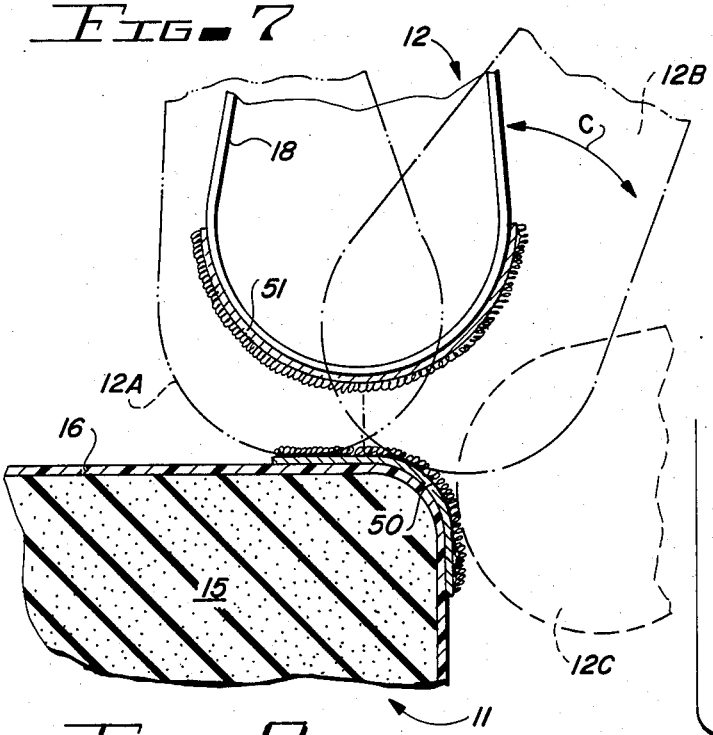
FIG. 9 is a side section view of the portable bathtub liner of FIG. 1 illustrating yet another method of interconnecting the resilient pads thereof; and, FIG. 10 is a section view of the portable bathtub liner of FIG. 1 illustrating yet another method of interconnecting the panels thereof.

Side pads 12–14 can, as shown in FIG. 7, be connected to bottom pad 11 by pliant and/or resilient strips 45 of material. Strips 45 are sized to permit a side pad 13 to be positioned on top of base pad 11 in the manner of pad 14 in FIG. 3 or to be positioned next to pad 11 in the manner of pads 12, 13 in FIG. 4.

As an alternate method of attaching a side pad 12 to bottom pad 11, a strip of positive hook and loop material 50 can be secured to bottom pad 11 and strip of negative hook and loop material 51 can be secured to side pad 12. Side pad 12 can then, as indicated by ghost outlines 12A, 12B, and 12C be rotated about pad 11 in the directions indicated by arrows C. This permits the liner of the invention to be readily adapted to different sized bathtubs. Attaching a side pad 12 to a bottom pad 11 with a strip 52 in the manner shown in FIG. 8 also permits the position at which the bottom of pad 12 contacts pad 11 to be adjusted as indicated by arrow D.

Figure 10:
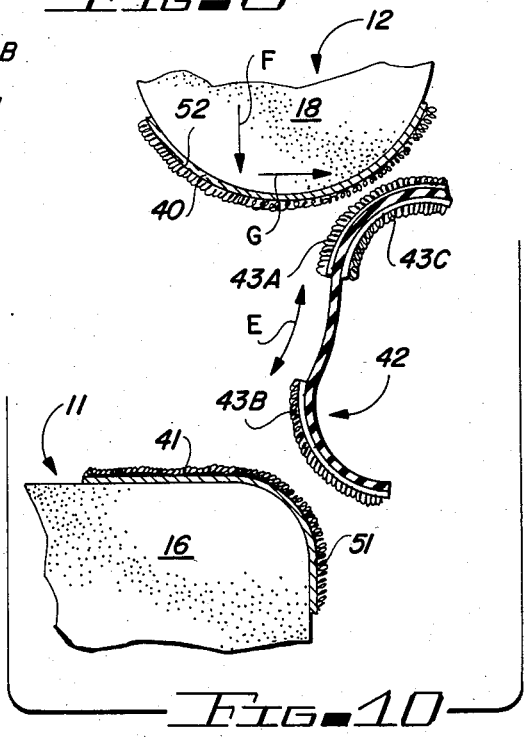

Elastic band 42 utilized in FIG. 5 can, as illustrated in FIG. 10, include positive hook and loop strips 43A, 43B, and 43C. When pad 12 is placed on pad 11 in the manner of pad 14 in FIG. 3, strip 43B is pressed against and detachably connected to the lower portion 51 of negative hook and loop strip 41, and pad 43C is pressed against portion 52 of negative hook and loop strip 40, then strip 42 is stretched as indicated by arrows E. When strip 42 is stretched, it pulls the bottom of pad 12 down and in as indicated by arrows F and G. Pulling the bottom of pad 12 in the direction of arrow G pulls and tends to maintain pad 12 against the side wall of a bathtub without requiring utilization of an auxiliary bracing system in conjunction with pad 12.

In use, the liner of FIG. 1 is placed in a bathtub in the manner shown in FIGS. 3 and 4. The bathtub includes upper peripheral surface 60, side surfaces 61–64, bottom surface 65, and drain 66. Aperture 27 is positioned over drain 66. Pad 11 is, as indicated by dashed line 67, preferably sloped so water will run down the upper surface of pad 11 under the force of gravity toward aperture 27. Headrest 20 extends above peripheral edge 60 of the bathtub. After the liner is placed in the bathtub water is drawn into the tub. The liner contours to and supports the body of an individual who then bathes in the tub.

As would be appreciated by those skilled in the art, pads 11–14 can be permanently installed in a bathtub, or, a bathtub can be manufactured in which the permanent inner surfaces of the tub are resilient and contour to portions of an individual's body pressed against said inner surfaces.

Hooks 30 and 31 can be removed or detached from straps 30A and 31A, respectively, and hung from a shower curtain bar or other support means. After the bathtub liner of the invention is utilized and removed from a tub, straps 30A and 31A can be reattached to hooks 30 and 31 to suspend the liner from the hooks to dry. Hooks 30 and 31 can be permanently secured to a support surface. Providing the bathtub liner of the invention with straps or other means which can be detachably secured to hooks 30, 31 or to other support means enables the liner to be utilized without requiring that the hooks remain attached to the liner when the liner is installed in a bathtub. When hooks 30, 31 remain attached to the liner, they can, if fabricated from metal or other hard materials, scratch and mar the inner surfaces of a bathtub.

The center of gravity J of each side pad 12–14 is preferably in the lower half of the pads. The lower half of pad 13 is indicated in FIGS. 1 and 5 by arrows I. Arrows H represent the full height of pad 13. Fabricating side pads 12, 13 such that the center of gravity J is in the lower half of the pads stabalizes the pads in position against the vertical side inner surfaces of a bathtub. If the center of gravity K is located above the midline L of the height of a side pad 12, 13, then the pad tends to be unstable and more readily fall or be moved away from its desired position against the vertical inner side surface of a bathtub.

Having described the invention in such terms as to enable those skilled in the art to which it pertains to understand and practice it, and having described the presently preferred embodiments thereof, we claim:

1. In combination with a bathtub having a drain, an upper peripheral edge, a bottom surface and inner side surfaces, a portable resilient bathtub liner including (a) a first resilient pad covering and contacting said bottom surface of said bathtub, said pad including an inner core of resilient material enclosed by a layer of water resistent material which detachably adheres to said bottom surface of said bathtub, said pad tapering from one of said ends to the other of said ends such that water in the bathtub flows under the force of gravity from one of said ends down said pad toward said bathtub drain when water is being emptied from said bathtub through said drain;

(b) an upright elongate second resilient pad of generally uniform symmetrical triangular cross section along the length thereof and positioned inside said upper peripheral edge of said bathtub and having (i) an elongate bottom portion positioned adjacent said first pad and parallel to said bottom surface of said bathtub, (ii) an elongate top portion generally parallel to said bottom portion, (iii) a height equal to the shortest distance between said bottom portion and said top portion, (iv) an outer generally continuous smooth planar surface spanning the distance between said top and bottom portions, facing one of said inner side surfaces of said bathtub, and formed of a material which detachably adheres to said one of said side surfaces, substantially the entire area of said outer surface contacting said one of said side surfaces of said bathtub, (v) an inner generally smooth planar surface opposed to and spaced apart from said outer surface, spanning the distance between said top and bottom portions, and sloping upwardly from said bottom portion toward said one of said side surfaces of said bathtub and said outer planar surface of said second pad, the center of gravity of said second pad being in said second pad at a distance from said bottom portion equal to less than one-half of said height of said second pad, the force of gravity's acting on said second pad stabilizing said second pad against said one of said side surfaces of said bathtub; and, (c) elastic strap means having (i) a first end attached to said first pad, and (ii) a second end attached to said bottom portion of said second pad, said elastic strap means pulling said bottom portion of said second pad downwardly toward said bottom surface of said bathtub.

2. The bathtub liner of claim 1, wherein said elastic strap means pulls said bottom portion of said second pad toward said one of said side surfaces of said bathtub.

3. The bathtub liner of claim 2, wherein said first and second pads are adapted to permit said elastic strap means to be detachably secured thereto in two operative positions, (a) a first operative position in which said elastic strap means pulls said second pad toward a side wall of the bathtub; and, (b) a second operative position for folding said second pad over said first pad.

* * * * *